US009852865B2

(12) United States Patent
Kroeker et al.

(10) Patent No.: US 9,852,865 B2
(45) Date of Patent: Dec. 26, 2017

(54) ELECTRICAL SWITCHING ARRANGEMENT WITH IMPROVED LINEAR BEARING

(71) Applicant: TE Connectivity Germany GmbH, Bensheim (DE)

(72) Inventors: Matthias Kroeker, Mittenwalde-Ragow (DE); Peter Sandeck, Berlin (DE); Udo Gabel, Berlin (DE); Thomas Haehnel, Berlin (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 15/205,423

(22) Filed: Jul. 8, 2016

(65) Prior Publication Data

US 2017/0011878 A1 Jan. 12, 2017

(30) Foreign Application Priority Data

Jul. 8, 2015 (DE) ..... 10 2015 212 801

(51) Int. Cl.

| | |
|---|---|
| ***H01H 3/00*** | (2006.01) |
| ***H01H 50/36*** | (2006.01) |
| ***H01F 7/16*** | (2006.01) |
| ***H01H 50/20*** | (2006.01) |
| ***H01H 50/22*** | (2006.01) |
| ***H01H 50/60*** | (2006.01) |

(52) U.S. Cl.

CPC ..... *H01H 50/36* (2013.01); *H01F 7/1607* (2013.01); *H01H 50/20* (2013.01); *H01H 50/22* (2013.01); *H01H 50/60* (2013.01)

(58) Field of Classification Search

CPC ..... H01H 33/04; H01H 1/20; H01H 51/04; H01H 51/065; H01H 50/10; H01H 50/20; H01H 50/22; H01H 50/36; H01H 50/23; H01H 50/34; H01H 50/305; H01F 7/08; H01F 7/16; H01F 7/1607; H01F 7/121; H01F 7/126; H01F 7/18; H01F 7/1844; H01F 2007/163; H01F 2007/0083

USPC ..... 335/189

See application file for complete search history.

(56) References Cited

U.S. PATENT DOCUMENTS

| | | | | |
|---|---|---|---|---|
| 2,807,687 A | | 9/1957 | Fischer et al. | |
| 2,890,309 A | | 6/1959 | Peter | |
| 3,172,975 A | * | 3/1965 | Williams | H01H 50/20 335/124 |
| 3,806,850 A | | 4/1974 | McFarlin | |
| 4,604,597 A | * | 8/1986 | Bogner | H01H 51/065 335/127 |
| 4,646,043 A | | 2/1987 | Hoffman | |
| 6,443,023 B1 | * | 9/2002 | Kajino | F02N 11/087 290/38 R |
| 6,911,884 B2 | | 6/2005 | Uotome et al. | |

(Continued)

OTHER PUBLICATIONS

European Search Report, dated Nov. 8, 2016, 9 pages.

*Primary Examiner* — Shawki S Ismail
*Assistant Examiner* — Lisa Homza
(74) *Attorney, Agent, or Firm* — Barley Snyder

(57) ABSTRACT

An electrical switch comprising a solenoid assembly including a core casing having a first bearing site and a bearing bush having a second bearing site, an armature movably borne in a switching direction at the first bearing site, and an armature shaft fixed to and movable with the armature and movably borne in the switching direction at the second bearing site.

14 Claims, 3 Drawing Sheets

(56) References Cited

U.S. PATENT DOCUMENTS 7,859,373 B2 * 12/2010 Yamamoto ..... H01H 50/305 335/126
8,138,868 B2 3/2012 Arnold
8,354,905 B2 * 1/2013 Eum ..... H01H 51/065 335/126
8,558,648 B2 * 10/2013 Choi ..... H01H 51/065 200/245
8,653,913 B2 * 2/2014 Vellaiyanaicken .. H01H 1/2025 335/126
8,928,436 B2 * 1/2015 Hirabayashi ..... H01H 50/023 335/131
9,281,148 B2 * 3/2016 Enomoto ..... H01H 1/20
9,496,109 B2 * 11/2016 Lee ..... H01H 50/10
2004/0027776 A1 * 2/2004 Uotome ..... H01H 47/06 361/160
2004/0032309 A1 * 2/2004 Kajino ..... H01H 51/065 335/126
2004/0093718 A1 5/2004 Takeuchi et al.
2006/0050466 A1 * 3/2006 Enomoto ..... H01H 50/02 361/160
2009/0322453 A1 * 12/2009 Kawaguchi ..... H01F 7/1615 335/81
2011/0120844 A1 * 5/2011 Hoffmann ..... H01H 50/02 200/275
2012/0260770 A1 * 10/2012 Nawa ..... F02N 11/087 74/7 C
2013/0076464 A1 * 3/2013 Yano ..... H01H 1/66 335/193
2013/0240495 A1 * 9/2013 Yano ..... H01H 9/36 219/123
2015/0054605 A1 * 2/2015 Kubono ..... H01H 50/60 335/177
2015/0380145 A1 * 12/2015 Koch ..... G01S 17/06 335/282
2016/0260563 A1 * 9/2016 Shima ..... H01H 50/023

* cited by examiner

ELECTRICAL SWITCHING ARRANGEMENT WITH IMPROVED LINEAR BEARING

CROSS-REFERENCE TO RELATED APPLICATION

This application claims the benefit of German Patent Application No. 102015212801.6, filed Jul. 8, 2015.

FIELD OF THE INVENTION

The invention relates to an electrical switch and, more particularly, to an electrical switch with a movable armature.

BACKGROUND

Electrical switches, such as relays, are known in the art. Patents U.S. Pat. No. 6,911,884 B2 and U.S. Pat. No. 8,138,863 B2 each disclose an electrical switch having a solenoid, a movable armature, an armature shaft attached to the movable armature, a contact assembly with a plurality of contacts, and other components. The contact assembly is located in a switching chamber region such that any electrical arcs which may arise can be sealed off from an electromagnetic drive system. The contact assembly is attached to the armature shaft, which penetrates a covering plate at a contact chamber aperture. The armature shaft is attached to the armature such that a movement of the armature is also transmitted to the contact assembly.

Due to mechanical tolerances in the overall design and contact wear from electrical arcs, the contacts of the contact assembly never touch corresponding mating contacts at the same time. Such a premature, one-sided mechanical contact initiates a force eccentric to the axis of a guide guiding motion of the armature. The spacing between the end of the armature shaft and the prematurely contacted contact acts as a lever, which tilts the guide. Since such an electrical switch is used to switch large loads, the contact forces for switching are high, leading to large radial forces transmitted by the lever to the guide. These forces can lead to wear on bearing surfaces of the guide or may even lead to the locking of the guide.

A locking of the guide can be avoided if the lever follows the condition $(A/L)\times 2\mu \leq 1$, with A being the lever length, L the bearing length, and $\mu$ the friction factor.

Elongating the bearing length can prevent locking but impairs the shock resistance of the electrical switch. The contact chamber aperture can be used as a second bearing surface, however, this would require precise mechanical tolerances to avoid a lateral offset of the two bearing surfaces, which would lead to locking.

Locking may also be prevented by reducing the friction factor. However, reducing the friction factor is only possible to a limited extent and requires expensive bearing coatings such as polytetrafluoroethylene (PTFE). Furthermore, such a coating can become worn over the lifespan of the electrical switch, increasing the friction factor over time.

SUMMARY

The disclosed electrical switch comprises a solenoid assembly including a core casing having a first bearing site and a bearing bush having a second bearing site. The electrical switch also includes an armature movably borne in a switching direction at the first bearing site. The electrical switch further includes an armature shaft fixed to and movable with the armature and movably borne in the switching direction at the second bearing site.

BRIEF DESCRIPTION OF THE DRAWINGS

The invention will now be described by way of example with reference to the accompanying figures, of which.

DETAILED DESCRIPTION OF THE EMBODIMENT(S)

The invention is explained in greater detail below with reference to embodiments of an electrical switch. This invention may, however, be embodied in other different forms and should not be construed as limited to the embodiments set forth herein; rather, these embodiments are provided so that this disclosure will be thorough and complete and still fully convey the scope of the invention to those skilled in the art.

Figure 1:
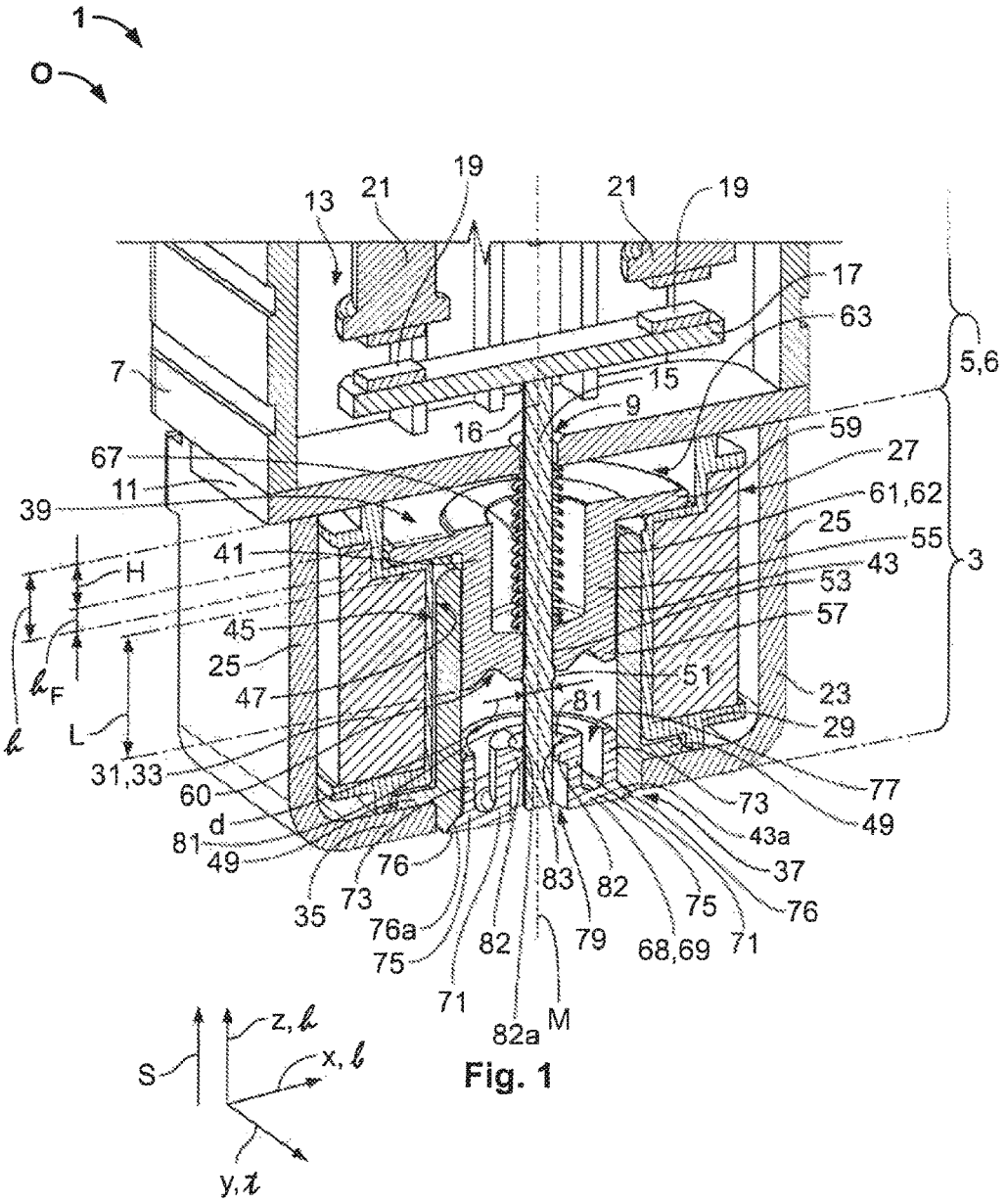
FIG. 1 is a sectional view of an electrical switch according to the invention.
Figure 2:
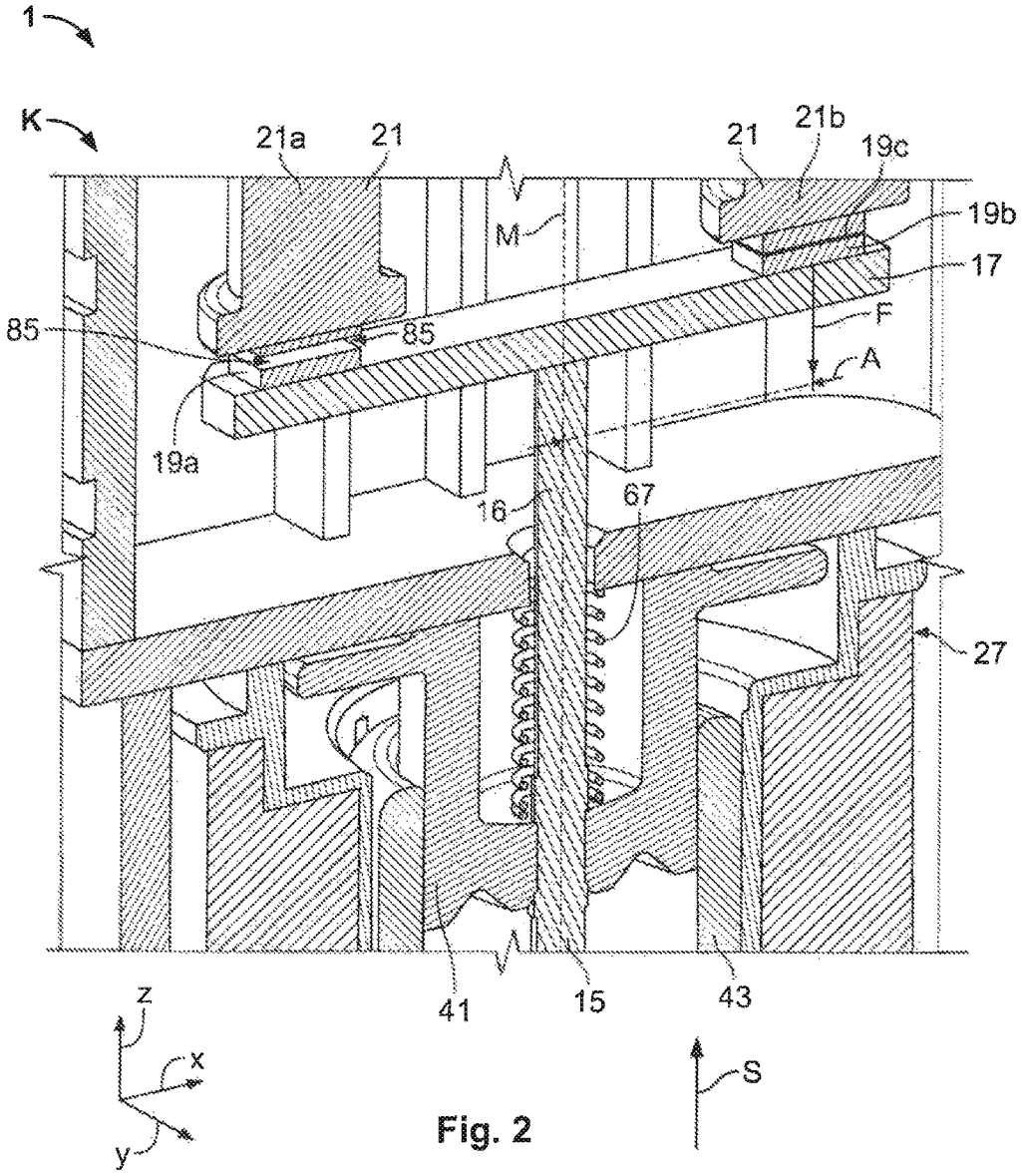
FIG. 2 is a detail view of the electrical switch of FIG. 1.

An electrical switch 1, according to the invention, is shown in FIGS. 1 and 2. The electrical switch 1 has a solenoid assembly 3 and a contact chamber 5. As shown in FIG. 1, the electrical switch 1 extends in a width b, which is measured along an x-axis, a depth t, which is measured along a y-axis, and a height h, which is measured along a z-axis.

The contact chamber 5, as shown in FIG. 1, has an upper housing 7 and a contact chamber plate 11, which together enclose an upper chamber 13. The contact chamber plate 11 has a contact chamber aperture 9 located approximately centrally on the contact chamber plate 11.

An armature shaft 15 extends into upper chamber 13 through contact chamber aperture 9. Armature shaft 15 has a diameter d.

A contact plate 17 is affixed to an end 16 of armature shaft 15 within upper chamber 13. Contact plate 17 has two armature contacts 19. By moving armature shaft 15 in a switching direction S, armature contacts 19 can contact electrical contacts 21, closing a current circuit. Electrical contacts 21 are connected to upper housing 7.

The solenoid assembly 3, as shown in FIG. 1, has a yoke 23 connected to the contact chamber plate 11. The yoke 23 has, sectioned along a plane spanning in the x and the y direction, a U-shape which is open in the z direction. The yoke 23 has a floor 35 with a circular floor aperture 37. Lateral walls 25 of yoke 23 enclose a solenoid 27.

Solenoid 27 is rotationally symmetric relative to a central axis M, which is also the central axis M for armature shaft 15. Solenoid 27 has a pancake coil 29, which is rotationally symmetrical about central axis M. Solenoid 27 also has a solenoid wire 33 with loops 31 circumferentially coiled around pancake coil 29. The loops 31 are symbolically represented in FIG. 1 as a whole and not as individual loops. Pancake coil 29 bears against the contact chamber plate 11 in switching direction S and, counter to switching direction S, bears against floor 35 of the yoke 23.

Solenoid 27 also has an inner space 39. An armature 41 is entirely disposed within inner space 39 of solenoid 27, while a core casing 43 is partially disposed within inner space 39 of solenoid 27. Core casing 43 is formed of a magnetic material, such as pure iron with a galvanic coating of bronze or a Teflon-coated piece of pure iron.

An outer wall 45 of core casing 43 abuts an inner wall 47 of pancake coil 29. A protrusion 49 of core casing 43 rests against the pancake coil 29 in the z direction, and, counter to the z direction, against floor 35 of yoke 23. Both pancake coil 29 and core casing 32 are secured against movement in or counter to the z direction by yoke 23 and contact chamber plate 11.

A lower end of the core casing 43 is received in the circular floor aperture 37. The lower end of the core casing 43 has a casing chamfer 43*a* which is inclined relative to the central axis M. The lower end of core casing 43 is positioned outside of solenoid 27, but does not project beyond yoke 23, and thus is contained within the outer dimensions of solenoid assembly 3.

Armature 41 and armature shaft 15 are rotationally symmetric about central axis M. Armature shaft 15 has a knurl 51, . . . , The section of armature shaft 15 having knurl 51 is connected to armature 41 at an armature attachment 53. In the shown embodiment, the armature attachment 53 is a laser weld, but one with ordinary skill in the art would understand that other attachments known in the art could be used as the armature attachment 53.

Armature shaft 15 is disposed in inner space 39 of solenoid 27, penetrates armature 41 at armature attachment 53, and projects out of solenoid assembly 3 through contact chamber aperture 9. In the shown embodiment, armature shaft 15 is made of a steel such as Cr—Ni steel, but one with ordinary skill in the art would understand that other materials, such as brass, are possible. Armature shaft 15 may have a rounded or angled cross-section.

Armature 41 has a cylindrical armature body 55 sealed by an armature floor 57 at an end situated counter to switching direction S. Armature floor 57 has a groove 60 extending annularly around central axis M. In the shown embodiment, groove 60 of armature floor 57 has a V-shaped cross-section, but groove 60 of armature floor 57 may alternatively have a rectangular or semicircular cross-section. Armature 41 also has an armature flange 59 positioned at an opposite end in switching direction S. In the shown embodiment, armature flange 59 is materially bonded to armature body 55, but armature flange 59 may alternatively be integrally formed with armature body 55.

Armature body 55 is partially surrounded by core casing 43 and is guided within core casing 43 in switching direction S over a bearing length L. Armature body 55 is guided and movably bears on a first bearing site 61 of core casing 43, which forms a first bearing surface 62.

Armature flange 59 is located in a cavity 63 formed by pancake coil 29 and contact chamber plate 11. Cavity 63 has a height h and armature flange 59 has a flange height hF. Flange height hF is measured in switching direction S from the position at which armature flange 59 abuts pancake coil 29 up to a portion of armature 41 which projects furthest in the switching direction S.

Armature shaft 15 is fixed to armature 41 and extends from armature floor 57 through cavity 63. Armature shaft 15 is surrounded by a spring 67 such that the spring 67 abuts both armature floor 57 and a side of contact chamber plate 11 which points counter to the switching direction S.

Figure 3:
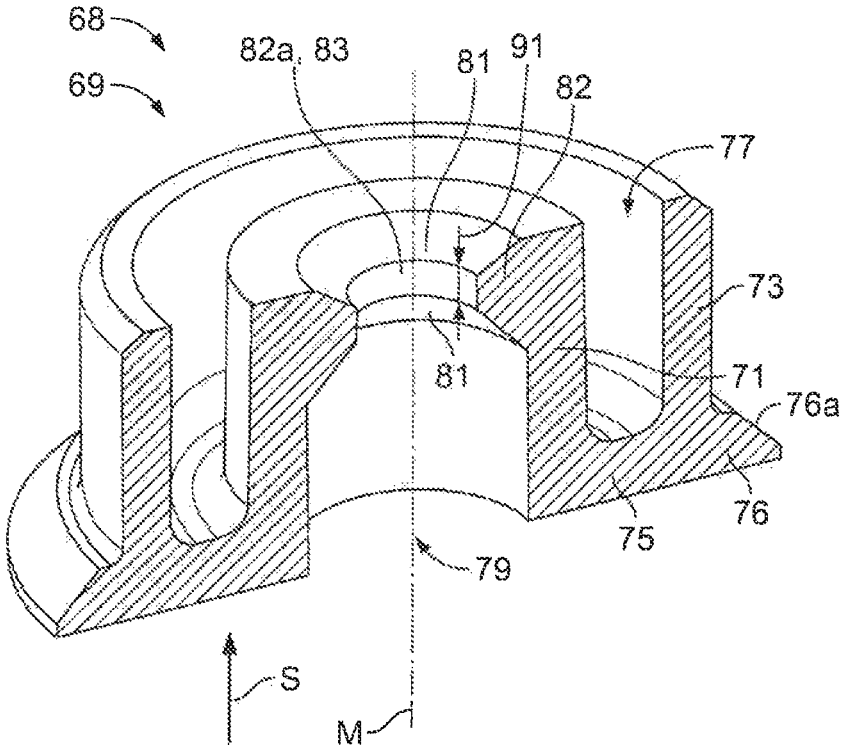
FIG. 3 is a sectional view of the bearing bush of the electrical switch of FIG. 1.

At an end of solenoid assembly 3 opposite contact chamber 5, a bearing element 68 in the form of a bearing bush 69 is inserted and form-fit into core casing 43. The bearing bush 69 is shown in FIGS. 1 and 3, and is made of a plastic material.

Bearing bush 69 has an inner bearing section 71, an outer bearing section 73, and an annular disc 75 connecting inner bearing section 71 and outer bearing section 73. Inner bearing section 71, outer bearing section 73, and annular disc 75 are symmetrical about central axis M and are connected to one another by material bonding at a side of bearing bush 69 counter to the switching direction S. Bearing bush 69 also has an annular trench 77 formed between inner bearing section 71 and outer bearing section 73.

Bearing bush 69 has a bearing flange 76. In the shown embodiment, bearing flange 76 is monolithically formed with annular disc 75, but the bearing flange 76 could alternatively be attached to annular disc 75. Bearing bush 69 may be formed by injection-molding or by other forms of production known to those with ordinary skill in the art.

Bearing flange 76 extends away from the central axis M, projecting past outer bearing section 73. Bearing flange 76 abuts an end of core casing 43 facing counter to switching direction S and prevents bearing bush 69 from being inserted deeper into core casing 43. Bearing flange 76 has a bearing chamfer 76*a* complementary to casing chamfer 43*a*, such that casing chamfer 43*a* abuts bearing chamfer 76*a* along a surface inclined away from central axis M. In the shown embodiment, both bearing chamfer 76*a* and casing chamfer 43*a* have a 45° angle.

Bearing bush 69, as shown best in FIG. 3, has a cylindrical receiving aperture 79 which tapers at insertion slopes 81. This taper represents an annular step 82 which protrudes inwards from the inner bearing section 71 to the central axis M. Annular step 82 forms a bush bearing surface 82*a*, which acts as a second bearing site 83 having a length 91. Second bearing site 83 is not centered in bearing bush 69, but rather is arranged offset in bearing bush 69 in switching direction S, i.e. toward the interior of solenoid assembly 3. Second bearing site 83 is spaced apart from first bearing site 61.

Armature shaft 15 is received in and movably bears on second bearing site 83. A length of second bearing site 83 in switching direction S is at most half of a diameter of armature shaft 15. Insertion slopes 81 simplify the introduction of armature shaft 15 into bearing bush 69 by centering armature shaft 15 with respect to bearing bush 69.

The assembly and use of electrical switch 1 will now be described with reference to FIGS. 1 and 2.

Contact chamber 5 forms a cover 6 which is attached to and seals off solenoid assembly 3. Cover 6 may be attached to solenoid assembly 3 by welding, gluing, screwing, riveting, or other forms of fastening known to those with ordinary skill in the art. Cover 6 separates solenoid assembly 3 from armature contacts 19, shielding solenoid assembly 3 from electrical arcs. Contact chamber aperture 9 is the sole connection between solenoid assembly 3 and upper chamber 13.

FIG. 1 shows electrical switch 1 in an open position 0, in which spring 67 is not prestressed or is only slightly prestressed. FIG. 2 shows electrical switch 1 in a contact position K. Contact position K represents the first mechanical contact between contact plate 17 and electrical contacts 21. In contact position K, armature 41 and armature shaft 15 have been moved by the magnetic field of solenoid 27 in switching direction S. During movement, armature 41 bears on first bearing site 61, while armature shaft 15 bears on second bearing site 83. Since second bearing site 83 is narrow, friction on armature shaft 15 is reduced. A stroke H of the electrical switch 1 in the transition from open position O to contact position K is the difference between height h and flange height hF.

The movement of armature 41 and armature shaft 15 is transmitted to contact plate 17. As shown in contact position K in FIG. 2, a first armature contact 19*a* does not touch a first electrical contact 21*a*, while a second armature contact 19*b* does touch a second electrical contact 21*b*. Between the first electrical contact 21*a* and the first armature contact 19*a*, a gap 85 must be overcome before the mechanical contact is made. Gap 85 may arise from contact plate 17 being tilted or by first armature contact 19*a* being affected by burnout, for example from electrical arcs, such that first armature contact 19*a* has been shortened. This tilting cannot be wholly avoided by electrical switch 1, but is minimized by the armature 15 bearing on both first bearing site 61 and second bearing site 83. The spacing between first bearing site 61 and second bearing site 83 increases a bearing length of armature shaft 15 to resist higher tilting moments.

The initial mechanical touching of the contact plate 17 with second electrical contact 21*b* leads to the transverse force F, which is transmitted from the magnetic field of solenoid 27 to armature 41 and armature shaft 15, acting on contact plate 17 along a direction counter to switching direction S. Transverse force F is transmitted over a lever length A onto armature shaft 15, tilting armature 41 within core casing 43. Lever length A is measured from central axis M to second armature contact 19*b*. Since the second armature contact 19*b* bears against the second electrical contact 21*b* over a large area, a mechanical point of application 19*c* is located centrally on the second armature contact 19*b* in the x-direction.

Advantageously, the electrical switch 1 according to the present invention, due to the first bearing site 61 and the second bearing site 83, resists tilting and locking of the armature shaft 15 without reducing shock resistance or requiring a costly bearing coating.

What is claimed is:

1. An electrical switch, comprising:

a solenoid assembly having:

(a) a core casing having a first bearing site, and (b) a bearing bush having a second bearing site;

an armature movably borne in a switching direction at the first bearing site; and an armature shaft:

(a) fixed to and movable with the armature, and (b) movably borne in the switching direction at the second bearing site and directly abutting the second bearing site.

2. The electrical switch of claim 1, wherein the armature shaft has an end adjacent an armature contact.

3. The electrical switch of claim 2, wherein the armature is positioned between the second bearing site and the end of the armature shaft adjacent the armature contact.

4. The electrical switch of claim 3, further including a cover attached to the solenoid assembly at the end of the armature shaft adjacent the armature contact.

5. The electrical switch of claim 1, wherein the bearing bush is disposed within the core casing.

6. The electrical switch of claim 5, wherein the bearing bush has a circumferential insertion slope.

7. The electrical switch of claim 6, wherein the bearing bush has a bearing flange.

8. The electrical switch of claim 7, wherein the bearing bush is attached to the solenoid assembly at the bearing flange.

9. The electrical switch of claim 8, wherein the bearing bush is disposed at one end of the core casing.

10. The electrical switch of claim 9, wherein the bearing bush seals an end of the core casing.

11. The electrical switch of claim 10, wherein the second bearing site is formed by an annular step of the bearing bush.

12. The electrical switch of claim 11, wherein the bearing bush is monolithically formed.

13. The electrical switch of claim 1, wherein a length of the second bearing site in the switching direction is at most half of a diameter of the armature shaft.

14. The electrical switch of claim 1, wherein the second bearing site is spaced apart from an end of the core casing.

* * * * *